US005108320A

United States Patent [19]

Kimber

[11] Patent Number: 5,108,320

[45] Date of Patent: Apr. 28, 1992

[54] ELECTRICAL LEAD WIRE TERMINAL CONNECTOR

[76] Inventor: Ray L. Kimber, 3588 W. 6000 So., Roy, Utah 84067

[21] Appl. No.: 702,331

[22] Filed: May 20, 1991

[51] Int. Cl.[5] ..... H01R 11/11

[52] U.S. Cl. ..... 439/883; 439/868; 439/801

[58] Field of Search ..... 439/433, 434, 860, 868, 439/883, 877, 849, 850, 781, 782, 786, 790, 791, 792, 801

[56] References Cited

U.S. PATENT DOCUMENTS 1,019,423 3/1912 Case ..... 439/868
1,309,887 7/1919 Fulton ..... 439/868
3,340,494 9/1967 Gutshall ..... 439/434
4,950,186 8/1990 Kaley et al. ..... 439/883
4,983,133 1/1991 Van Scyoc et al. ..... 439/860

FOREIGN PATENT DOCUMENTS 883150 6/1943 France ..... 439/781

*Primary Examiner*—David L. Pirlot
*Attorney, Agent, or Firm*—A. Ray Osburn

[57] ABSTRACT

An electrical wire terminal connector having a pair of spaced apart spades for attachment to the stem of an electrical post connector, incorporating a resilient washer and raised terminal contacting ribs, adapted for finger tightening along with efficient long lasting electrical connection.

7 Claims, 2 Drawing Sheets

ELECTRICAL LEAD WIRE TERMINAL CONNECTOR

BACKGROUND OF THE INVENTION

1. Field

The invention is in the field of electrical lead wire terminal connectors and more particularly such connectors which are adapted for use in finger-tight connected condition.

2. State of the Art

The problem of connecting electrical lead wires to terminal posts has engendered a very large number of electrical lead wire terminal connector designs. To a considerable extent, these designs have been directed to the problem of easily making and maintaining the mechanical and electrical connection. They range from connection of bare wire by wrapping it around the stem of a cap screw subsequently tightened with a screw driver, to lead wire terminal ends of varying complexity. Such lead wire terminal connectors have, both for single strand and for twisted strand lead wires, been more reliable and less destructive of the lead wires. Also, finger tightenable terminal post connectors avoid inconvenient and sometimes destructive use of tools for electrical setup and dismantling. With tools, excessive force is too easily applied to the connector elements. However, with state of the art lead wire terminal connectors, tool tightening is often necessary for long lasting electrical connection.

Lead wire terminal connectors with flat contact surfaces especially require tool tightening,because of their large contact areas with the terminal post components. Accordingly, there have been a number of lead wire terminal connector designs with upstanding ridges or the like, which greatly reduce the area of contact resulting in highly concentrated electrical contact forces Examples include the lead wire terminal disclosed in United Kingdom patent application No. 2,183,404, and U.S. Pat. Nos. 3,861,780 and 1,608,578. However, these disclosed embodiments still require the electrical connection be made through essentially rigid mating components. Excessive tightening is therefore often still required. Further, these disclosed designs do nothing to maintain the contact over extended periods of time.

Therefore, a need definitely remains for an electrical lead wire terminal connector easily attached to terminal post connectors to permanently function, preferably without tightening tools.

BRIEF SUMMARY OF THE INVENTION

With the foregoing in mind, the prsent invention eliminates or substantially alleviates the shortcomings in present electrical lead wire terminal connectors, by providing such a connector which produces permanently maintained efficient electrical contact when attached to terminal post connectors even with only finger tightenable means. The lead wire end of the terminal connector has provisions for connection to the electrical lead wire. The terminal post end of the connector comprises a pair of spade-like plates each formed for placement about the stem of the terminal post connector. The lead wire terminal connector further comprises a washer-like member of resilient material sandwiched between the two spade plates. The two spade plates are secured together remotely from the post connection end of the connector, so that they are cantilevered unsupported and are substantially bendable under the force of the finger tightenable threaded cap provided on the post connector. The resiient washer gives elastically with the force of the tightened cap, and thereafter positively and permanently urges the spades into firm electrical contact against the post stem and cap. To further insure effective electrical contact, each spade plate is preferably provided with outwardly projecting corrugations or the like, providing concentrated contact area both with the cap and the stem of the terminal post. The resiliency of the washer member assures permanently maintained, evenly distributed, concentrated contact forces on the projectiong corrugations.

It is therefore the principal object of the invention to provide an improved electrical lead wire terminal connector for use with finger tightenable terminal post connectors.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
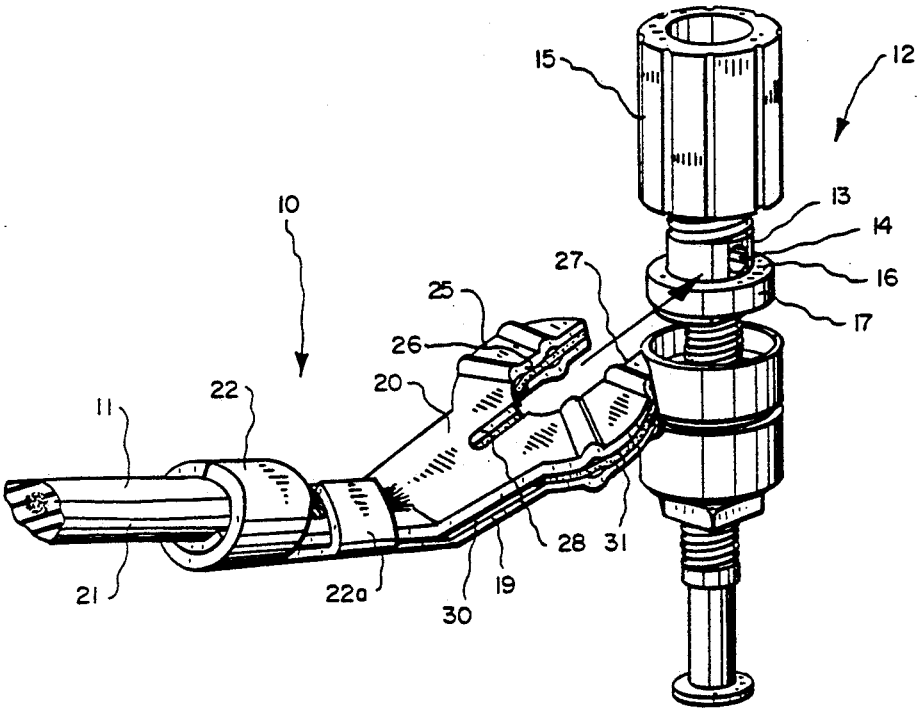
FIG. 1 is a perspective view of an electrical lead wire terminal connector in accordance with the invention attached to the end of an electric lead wire, said connector being indicated in position for attachment to a terminal post connector, drawn to approximately three times actual size, FIG. 2 a side elevation view of the lead wire terminal connector of FIG. 1 attached to the electrical post connector, the latter fragmentally shown, drawn to the scale of FIG. 1, FIG. 3 an end view of the electrical lead wire terminal connector of FIG. 2, taken along line 3—3 thereof, drawn to the same scale, FIG. 4 a top plan view of the electrical lead wire connector of FIG. 1 before attachment of the electrical lead wire thereto, drawn to the scale of FIG. 1, FIG. 5 a bottom view of the connector of FIG. 4, drawn to the same scale, FIG. 6 a plan view and a side view of the "C" washer of resilient material installed between the connector spades of the connector of FIGS. 1-5, drawn to the same scale, FIG. 7 a plan view of a fragment of an electrical lead wire terminal connector in accordance with the invention wherein the connecting spade is not open ended, drawn to the scale of FIG. 4, FIG. 8 a perspective view of a metallic Marcel washer installed between the connector spades in another embodiment of the invention, drawn to the scale of FIG. 6, and FIG. 9 a side elevational view of a fragment of an embodiment of the lead wire terminal connector comprising a single elongate plate including a spade end, the resilient means being adhered thereto, and incorporating a "C" washer shaped wear plate on the opposite side of the resilient washer, drawn to the approximate scale of FIG. 7.

An electrical lead wire terminal connector 10 is shown in FIG. 1 secured to an insulated electrical wire lead 11 preparatory to be joined to a post connector 12. Post connector 12 comprises a stem 13, often provided with a cross bore 14, and a finger tightenable threaded cap 15 on one of its ends. The electrical wire 11 is often connected by insertion through bore 14, with cap 15 then finger tightened thereupon to provide electrical contact between wire, post and cap. However, terminal connector 10 is configured to make the necessary electrical contact with the flat surface 16 of post connector shoulder 17 and also with opposing metallic base 18 of finger cap 15. (FIG. 2) A portion of post 12 below shoulder 17 is used for installation into a terminal board or the like, not shown, and varies considerably from one application to another.

Terminal connector 10 comprises a base plate 19 of electrically conducting material, such as 0.040" thick, nickelplated copper. Secured to base plate 19 is an upper plate 20 of the same material. Upper plate 20 conforms in shape to base plate 19 at the terminal post end. Upper plate 20 narrows to an upwardly concave lead connecting portion 21 fitting against the cylindrical outside of the insulation 21 of wire lead 11. Base plate 19 at its wire lead end has a pair of arcuately formed tangs 22, which are crimped to firmly grip insulation 21. (FIGS. 1-5)

Figure 2:
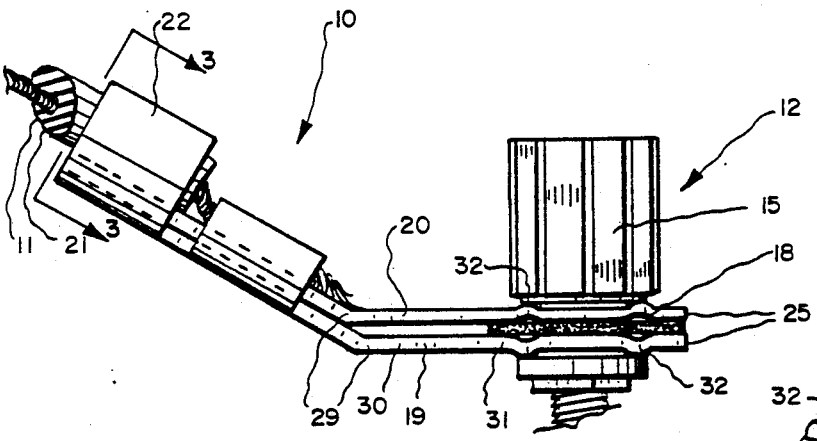
Figure 3:
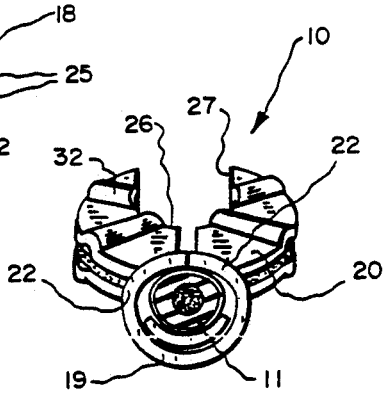
Figure 4:
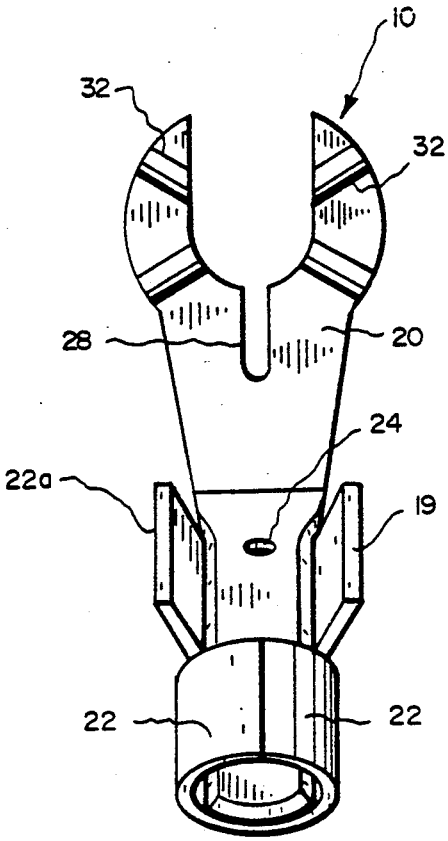
Figure 5:
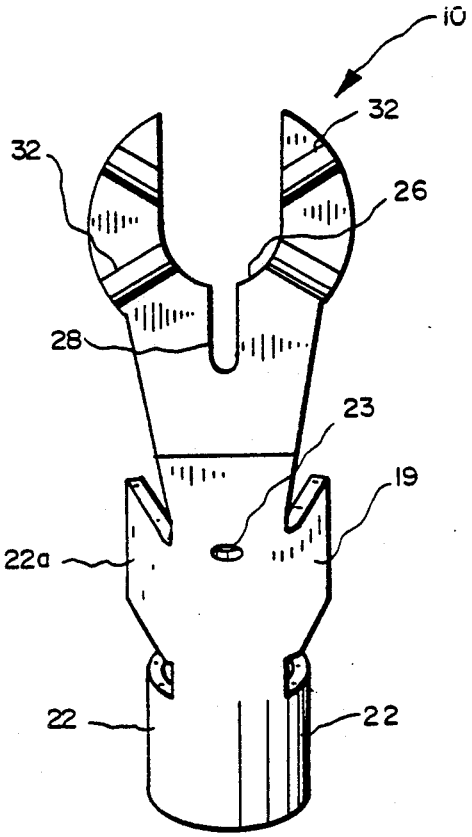
Figure 6:
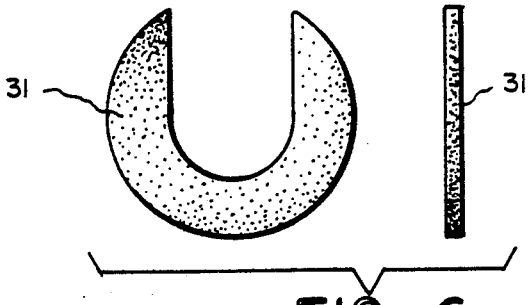

Forwardly of arcuate tangs is a pair of straight tangs **22*a*, tangentially joining the curved base plate. As best seen in FIGS. 1 and 2, forward tangs 22*a* are bent and crimped to contact and secure bare wire 11 protruding from insulation 21**.

Base plate 19 and upper plate 20 are preferably secured by punch sheared semicircular tabs 23 in the former, extending into matching holes 24 pre-punched into the latter.

A post connector spade portion 25 of terminal connector 10 is provided in the form of an open-ended "C". Arcuate central opening 26 joins with outwardly opening slot 27, so that spade 26 may be installed about post stem 13 beneath finger cap 15. An oppositely extending, smaller, slot 28 allows the spade "C" to elastically spread so that spade 25 may be snapped onto stem 13 to be loosely retained until cap 15 is finger tightened. This reduces frustration and aggravation when electrical wire circuits are being set up. Slot 28 also permits the "C" to be crimped together to accommodate somewhat smaller posts.

Base plate 19 and upper plate 20 are each preferably formed with spade end and lead wire ends joined at at substantial angle 29, to be subsequently attached with a gap 30 separating the spade ends. Installed within gap 30 is a "C"-shaped washer 31 of elastically compressible material. Silicon rubber is a preferred material, having unimpaired elasticity over a wide temperature range. The angular configuration of terminal connector 10 also facilitates connection to the post, by providing often needed finger space. Washer 31 may be retained by a suitable adhesive on one or both of its sides.

Substantial free bending lengths of both base and upper plates 19 and 20 are provided by their cantilevered lengths beyond.their attaching points. Their spade ends may therefore deflect a certain degree without exceeding the elastic limits of either plate. Resilient washer 31 also prevents excessive bending of the plates as cap 15 is finger tightened thereupon. The tightened finger cap urges both base and upper plates into continuing firm contact with shoulder 17 and cap face 18 respectively.

The spade ends of both base plate 19 and upper plate 20 are preferably formed with paired raised ridges 32 projecting from their outwardly facing surfaces. While ridges 32 may take various forms, base widths of approximately 0.060" and heights of approximately 0.010" arranged diametrically to spade central opening 26 have proven very satisfactory. Ridges 32 provide the reduced surface contact area with stem shoulder surface 16 and cap face 18 needed for enhanced unit force therebetween for reliable electrical connection. This unit force is multiplied many magnitudes over that available with flat spade surfaces.

"C" washer 31 is significantly compressible under the force of tightened cap 15, so that contact with ridges 32 remains not only positive after tightening but also evenly distributed between the ridges. The overall result is an extremely reliable connection, easily made and permanently maintained.

Figure 7:
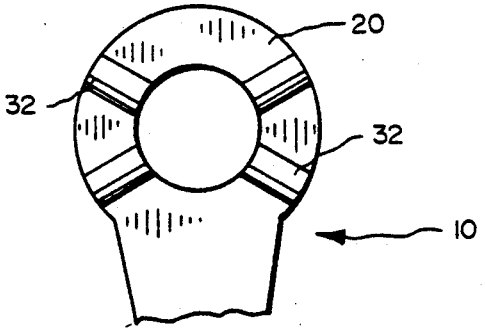
Figure 8:
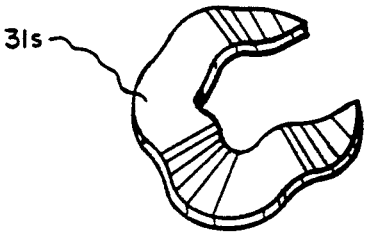

The lead terminal connector 10 may take other forms without departing from the spirit of the invention. The tabs 22 and **22*a* could be replaced with various other means for connecting the lead wire 11, such as a threaded bore through the plates along with a wire engaging cap screw for example. The recess in spade 25 need not be open ended, providing the finger cap 15 is removable from stem 13. (FIG. 7) Nor is the resilient washer 31 necessarily made of rubberoid material, since a resilient "Marcel" type metallic washer 31*s* could be employed, for example. (FIG. 8) Spot welds could be used to secure plates 19 and 20 together in lieu of the shear tabs 23 with matching bores 24. Also, plates 19 and 20 could be sheared together from stock sheet, joined at a bend line at the lead wire end of connector 10**.

Figure 9:
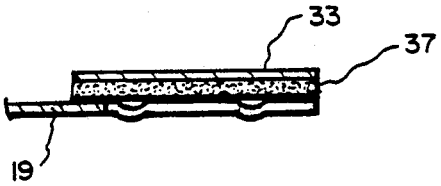

An embodiment having only one of the plates 19 or 20 extending to form spade 25 is also in accordance with the spirit of the invention, albeit undoubtedly less rugged and less efficient. (FIG. 9) In this embodimeht, resilient washer 31 is adhered to the single plate spade 25, and perhaps also to a wear plate 33 on its opposite face.

The capability of terminal connector 10 for use with finger tightenable terminal posts is emphasized as a very important attribute. However, use with tool tightened terminal posts is of course in no way precluded, although care against over tightening is adviseable.

The invention may be embodied in other specific forms without departing from the spirit or essential characteristics thereof. The present embodiments are therefore to be considered as illustrative and not restrictive, the scope of the invention being indicated by the appended claims rather than by the foregoing dexcription, and all changes that come within the meaning and range of equivalency of the claims are therefore intended to be embraçed therein.

What is claimed and desired to be secured by United States Letters Patent is:

1. A lead wire terminal connector for use with a terminal post connector having a stem along with finger tightenable connector securing means associated therewith, said lead wire connector comprising:

pair of elongate plates having matchingly configured and positioned spade means at one end of each, shaped for installation about the stem of the post connector, said plates being relatively shaped and secured together distantly from the spade ends thereof, so that the spades and substantial joining lengths of the plates are spaced apart;

resilient washer means secured in the space between the spades, so as to urge the spades into continuing firm contact with the terminal post connector when the spades are secured thereto by the finger tightenable securing means; and lead wire attaching means associated with the end of at least one of the elongate plates opposite the spade end thereof.

2. The lead wire terminal connector of claim 1, wherein:

the spade means and the washer means carrying matching, outwardly opening recesses permitting their installation about the stem by motion perpendicular thereto, without access to the end thereof.

3. The lead wire terminal connector of claim 2, wherein:

the resilient washer means is constructed from material selected from among natural rubber, a group of rubberoid synthetic plastics, and silicone rubber.

4. The lead wire terminal connector of claim 1, wherein:

the resilient washer means is constructed from material selected from among natural rubber, a group of rubberoid synthetic plastics,and silicone rubber.

5. The lead wire terminal connector of claim 4, wherein:

the elongate plates each comprise a straight portion including the associated spade means and a substantial joining length of the plate, and a straight portion comprising the remaining length of the plate at the lead wire end thereof, said straight portions being joined at an angle common to both plates, so that the lead wire ends of the plates may be secured together with the spade ends thereof spaced apart.

6. The lead wire terminal connector of claim 1, wherein:

the elongate plates each comprise a straight portion including the associated spade means and a substantial joining length of the plate, and a straight portion comprising the remaining length of the plate at the lead wire end thereof, said straight portions being joined at an angle common to both plates, so that the lead wire ends of the plates may be secured together with the spade ends thereof spaced apart.

7. The lead wire terminal connector of claim 6, wherein:

the washer means comprises a Marcel type washer of material selected from among resilient plastics and resilient metals.

* * * * *